US007972504B2

(12) United States Patent
Weiss

(10) Patent No.: US 7,972,504 B2
(45) Date of Patent: Jul. 5, 2011

(54) SKIMMER APPARATUS FOR USE WITH A BODY OF WATER

(76) Inventor: Scot H. Weiss, Orlando, FL (US)

( * ) Notice: Subject to any disclaimer, the term of this patent is extended or adjusted under 35 U.S.C. 154(b) by 221 days.

(21) Appl. No.: 12/123,386

(22) Filed: May 19, 2008

(65) Prior Publication Data

US 2008/0283457 A1 Nov. 20, 2008

Related U.S. Application Data

(60) Provisional application No. 60/938,457, filed on May 17, 2007.

(51) Int. Cl.
*E04H 4/16* (2006.01)

(52) U.S. Cl. ..... 210/167.2; 210/238; 210/242.1; 210/470

(58) Field of Classification Search ..... 210/776, 210/167.1, 167.19, 237, 238, 242.1, 470, 210/167.2; 4/496
See application file for complete search history.

(56) References Cited

U.S. PATENT DOCUMENTS 4,472,842 A * 9/1984 Jarrett ..... 4/490
4,518,495 A * 5/1985 Harding ..... 210/470
5,043,060 A * 8/1991 Brennan ..... 210/122
5,167,805 A 12/1992 Theiss
5,223,135 A * 6/1993 MacPhee et al. ..... 210/242.1
5,350,508 A * 9/1994 Van der Watt ..... 210/238
5,422,001 A * 6/1995 Yagoda et al. ..... 210/238
5,705,058 A 1/1998 Fischer
5,759,388 A * 6/1998 Cote ..... 210/470
6,132,604 A * 10/2000 Kirchoff ..... 210/470
6,270,683 B1 * 8/2001 Turner ..... 210/776
D521,198 S 5/2006 Byrne
7,146,658 B2 12/2006 Lyall

FOREIGN PATENT DOCUMENTS

DE 202004040156 U1 * 2/2005
TW 256071 U * 2/2005

* cited by examiner

*Primary Examiner* — Fred Prince
(74) *Attorney, Agent, or Firm* — Allen Dyer Doppelt Milbrath & Gilchrist

(57) ABSTRACT

A skimmer apparatus including a floatation element defining an operative top end and configured to remain on top of a body of water, a net material having a top edge connected to the floatation element and extending nearly a complete width of the floatation element, a non-floatation element defining an operative bottom and connected to a bottom edge of the net material, a guide element extending from a first side and second side of the floatation element and first side and the second side of the non-floatation element, and a handle attached to the end of the guide element distant from the floatation element and the non-floatation element.

17 Claims, 5 Drawing Sheets

SKIMMER APPARATUS FOR USE WITH A BODY OF WATER

CROSS-REFERENCE TO RELATED APPLICATIONS

This application claims priority to U.S. Provisional Application No. 60/938,457 filed May 17, 2007, incorporated herein by reference in its entirety.

FIELD OF INVENTION

The present invention relates to a device for removing debris from a surface of a body of water and, more particularly, to a surface skimmer that is able to remove debris and other large objects from a surface or close to the surface of a body of water.

BACKGROUND OF THE INVENTION

The use of pool skimmers are known in the prior art. The general configuration disclosed in the prior art proves for a mesh netting attached to a rigid frame and having a rigid handle which a user grasps as the user maneuvers the prior art skimmer through the water. For the prior art skimmers that extend the complete width of a pool, or nearly the complete width, two users are required when using such prior art skimmers where two rigid handles are provided. Due to the material used, the user or users are generally insuring that the skimmer does not become submerged below the water line. Further more, because of the rigid parts used, which provide additional weight, and the manner in which the parts are connected together, the prior art skimmers are generally limited as to the weight of debris that may be removed from a body of water.

Owners, operators, and users of bodies of water where debris is known to collect on top or near the top of water would benefit from a skimmer that does not require the user to prevent the skimmer from submerging while further providing for flexibility to use either one or two users to operate the skimmer. Having a skimmer that may be extending by attaching a plurality of other skimmers while still not requiring additional users because of the additional size is also beneficial.

BRIEF SUMMARY OF THE INVENTION

Embodiments of the invention disclose an apparatus for removing debris and other large objects from a surface or close to the surface of a body of water. A skimmer apparatus has a floatation element which defines an operative top end and is configured to remain on top of a body of water. A net material having a top edge is connected to the floatation element and extends nearly a complete width of the floatation element. A non-floatation element defines an operative bottom and is connected to a bottom edge of the net material. A guide element extends from a first side and/or a second side of the floatation element and/or a first side and/or a second side of the non-floatation element.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Figure 1:
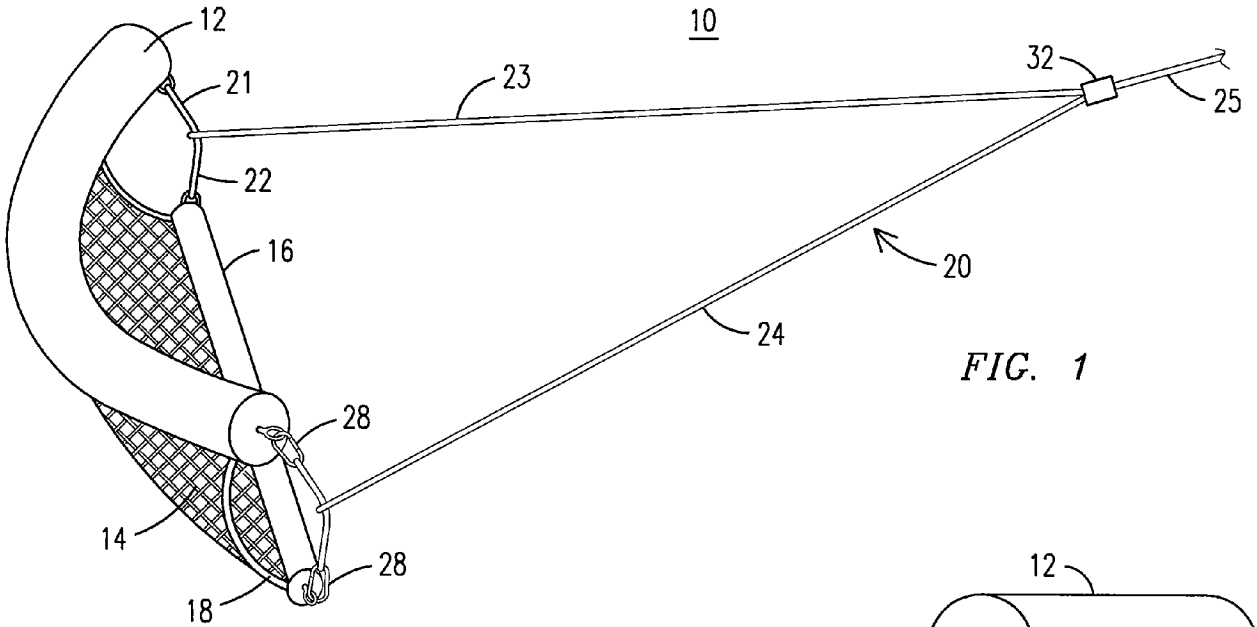
FIG. 1 depicts an exemplary embodiment of a perspective view of the skimmer apparatus.

Reference will now be made in detail to the embodiments consistent with the invention, examples of which are illustrated in the accompanying drawings. Wherever possible, the same reference numerals used throughout the drawings refer to the same or like parts.

Though exemplary embodiments of the present invention are generally envisioned for use with respect to swimming pools, the type of body of water is not limited to swimming pools. A skimmer apparatus may be used to in a smaller body of water, such as but not limited to a hot tub as well as in a much larger body of water, such as but not limited to a stream, pond, lake, bayou, ocean, etc. Furthermore, the use of the skimmer apparatus is not limited to removing debris from the body of water. The skimmer apparatus may be used as a rescue device to remove and/or assist an individual, or animal, which may be in distress when within the body of water.

FIG. 1 depicts an exemplary embodiment of a top view of the skimmer apparatus. A floatation element 12 is disclosed. The floatation element 12 defines an operative top end of the skimmer apparatus 10. Because of its floatation characteristics, the floatation element 12 is configured to remain on top of a body of water. A net material 14 having a top edge is connected to the floatation element 12 at the top edge. The net material 14 extends nearly a complete length of the floatation element 12. A non-floatation element 16 defining an operative bottom is connected to a bottom edge of the net material 14. A re-enforcement element 18 extends along an edge of the net material 14 from the floatation element 12 to the non-floatation element 16. In an exemplary embodiment the re-enforcement element 18 is elastic. Being elastic, the edge of the net material 14 attached to the re-enforcement element bunches together when the skimmer apparatus 10 is not being pulled through the body of water. While being pulled, depending on the strength of the re-enforcement element 18, bunching still occurs, but at a smaller amount. When placed on both side edge, the bunching closes off the side edges of the net material 14 so that debris collected in the net material 14 can not escape at the edges of the net material 14.

A guide element 20 extends from a first side and/or a second side of the floatation element 12 and/or a first side and/or a second side of the non-floatation element 16. More specifically the guide element 20 may include a plurality of ropes 21, 22, 23, 24, 25 each individually extending from the first side and second side of the floatation element and the first side and the second side of the non-floatation element. The guide element 20 may be attached to the floatation element 12 and/or the non-floatation element 16 with a connection element 28 having a loop, such as but not limited to a carabiner. In an exemplary embodiment, to insure a firm connection, a loop can be attached at the locations where the connection element 28 is connected.

The plurality of ropes may converge to form a single rope element 25 at a distance from the floatation element 12 and the non-floatation element 16. In another exemplary embodiment, the rope 21 extending from the first side of the floatation element 12 is combined with the rope 22 extending for the first side of the non-floatation element 16 connect to form a single rope 23. By converging the ropes 21, 22 from the same side of the floatation element 12 and the non-floatation element 16, uniform movement of that side of the skimmer apparatus is realized. This single rope 23 then converges to form a single rope with a similar rope 24 configuration from the second side of the floatation element 12 and non-floatation element 16. The distance 30 before the ropes converge is adjustable. This may be accomplished with a slideable device 32 upon the ropes 23, 24 to define where a base of a V-shape begins.

Figure 2:
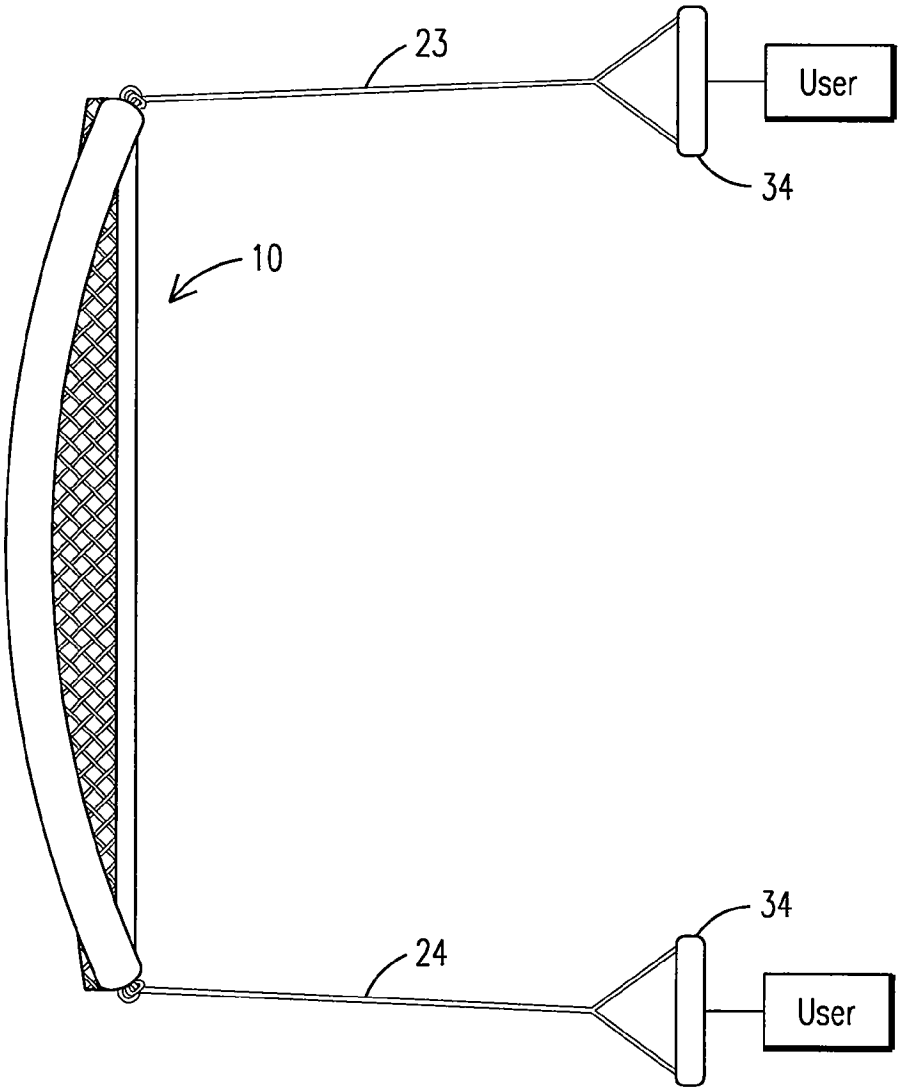
FIG. 2 depicts an exemplary embodiment of the skimmer apparatus where two users are used to operate the skimmer apparatus.

FIG. 2 depicts an exemplary embodiment of the skimmer apparatus where two users are used to operate the skimmer apparatus. As illustrated instead of the ropes 23, 24 coming together to form a V-shape, each end 23, 24 is provided for a different user, a first user and a second user, to use to handle the skimmer apparatus 10. For example, if a rescue mission is being accomplished where a first user is positioned in a first boat and a second user is located in a second boat, each user will hold a respect rope as each boat moves in unison through the body of water.

Figure 3:
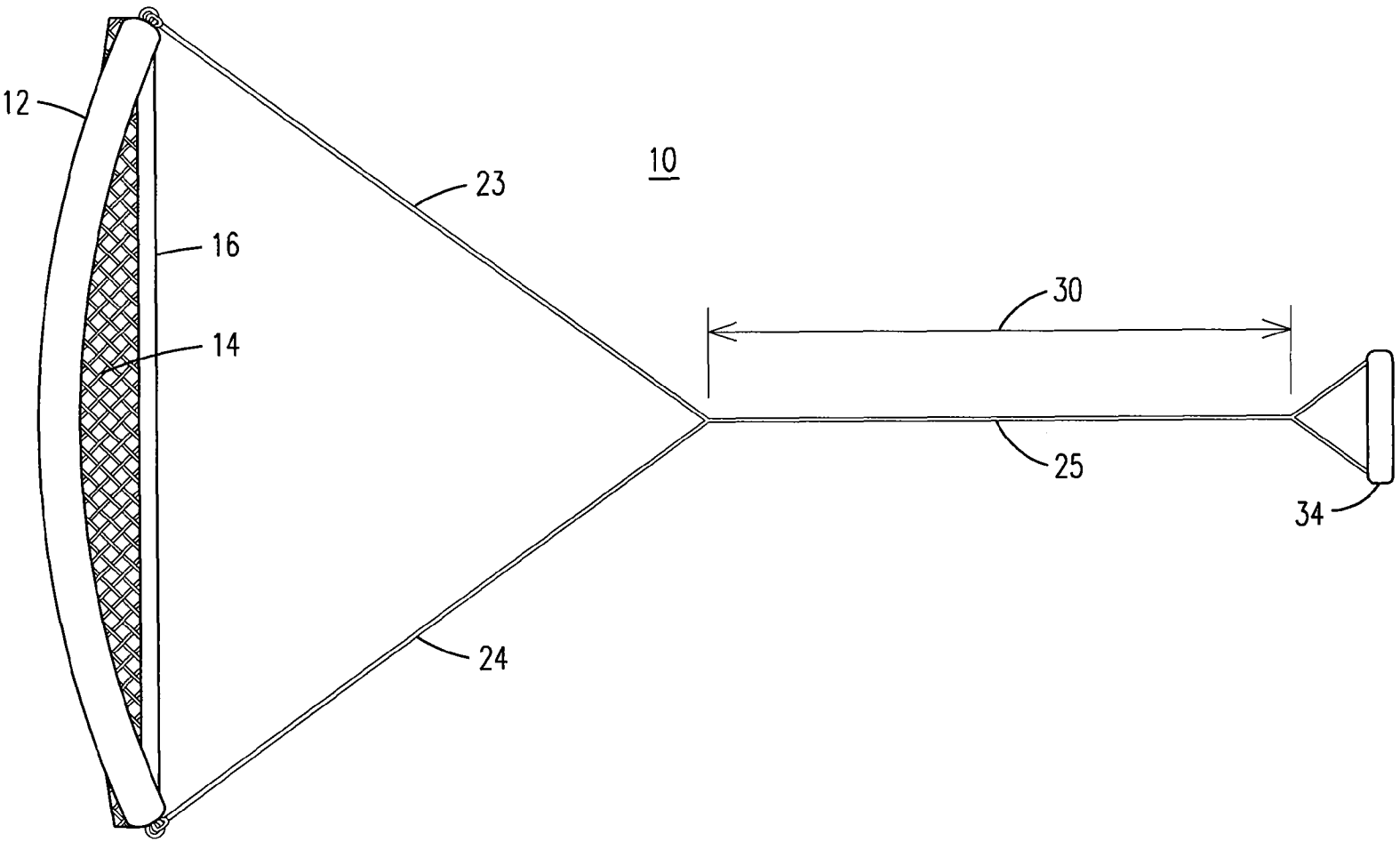
FIG. 3 depicts an exemplary embodiment of a top view of the skimmer apparatus.

FIG. 3 depicts an exemplary embodiment of a top view of the skimmer apparatus. As illustrated, a handle 34 is provided. The handle 34 is used by the user to guide the direction of the skimmer apparatus 10 when used within the body of water. With respect to the embodiment disclosed in FIG. 2, two handles 34 may be provided at the end of each respective rope 23, 24 where the first rope 23 is used by the first user and the second rope 24 is used by the second user.

In operation, the user may direct a direction the net material 14 is facing by maneuvering the handle 34 which in turn controls the ropes. By doing so, with respect to a swimming pool, the user will be able to remove debris from the surface or near surface of the pool quicker than using a net with a handle since the embodiments disclosed can continuously remove debris without taking the skimmer apparatus 10 out of the water. Furthermore, the user will be able to accomplish this task without requiring assistance from another individual.

Figure 4:
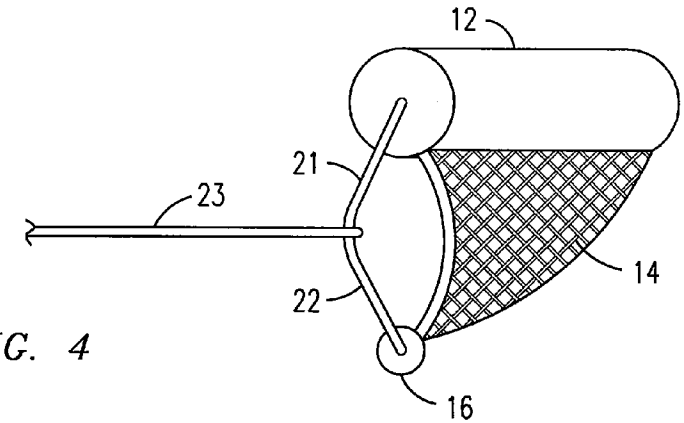
FIG. 4 depicts a side view of an exemplary embodiment of the skimmer apparatus with a smaller non-floatation element.

FIG. 4 depicts a side view of an exemplary embodiment of the skimmer apparatus with a smaller non-floatation element. The non-floating element 16 may be of a shorter length than the floatation element 12. In another exemplary embodiment, the non-floatation element 16 may include a plurality of non-floating elements that are placed at distinct locations across the bottom portion of the net material 14.

Figure 5:
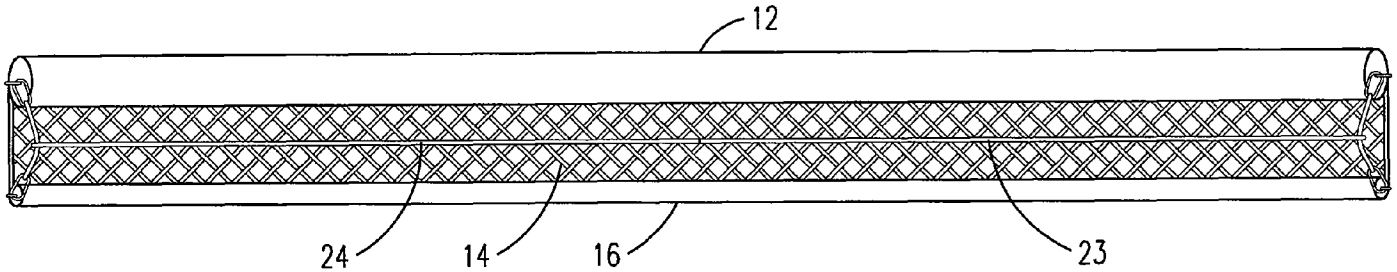
FIG. 5 depicts an exemplary embodiment of a front view of the skimmer apparatus.

FIG. 5 depicts an exemplary embodiment of a front view of the pool skimmer. For storing, the net material 14 may be rolled around the floatation element 12 or the non-floatation element 16. The ropes 23, 24, 25 can be wrapped around the floatation element 12 and/or the non-floatation element 16. In another exemplary embodiment, the floatation element 12 is made of a material that is foldable upon itself. The non-floatation element 16 is also foldable upon itself for storing.

Figure 6:
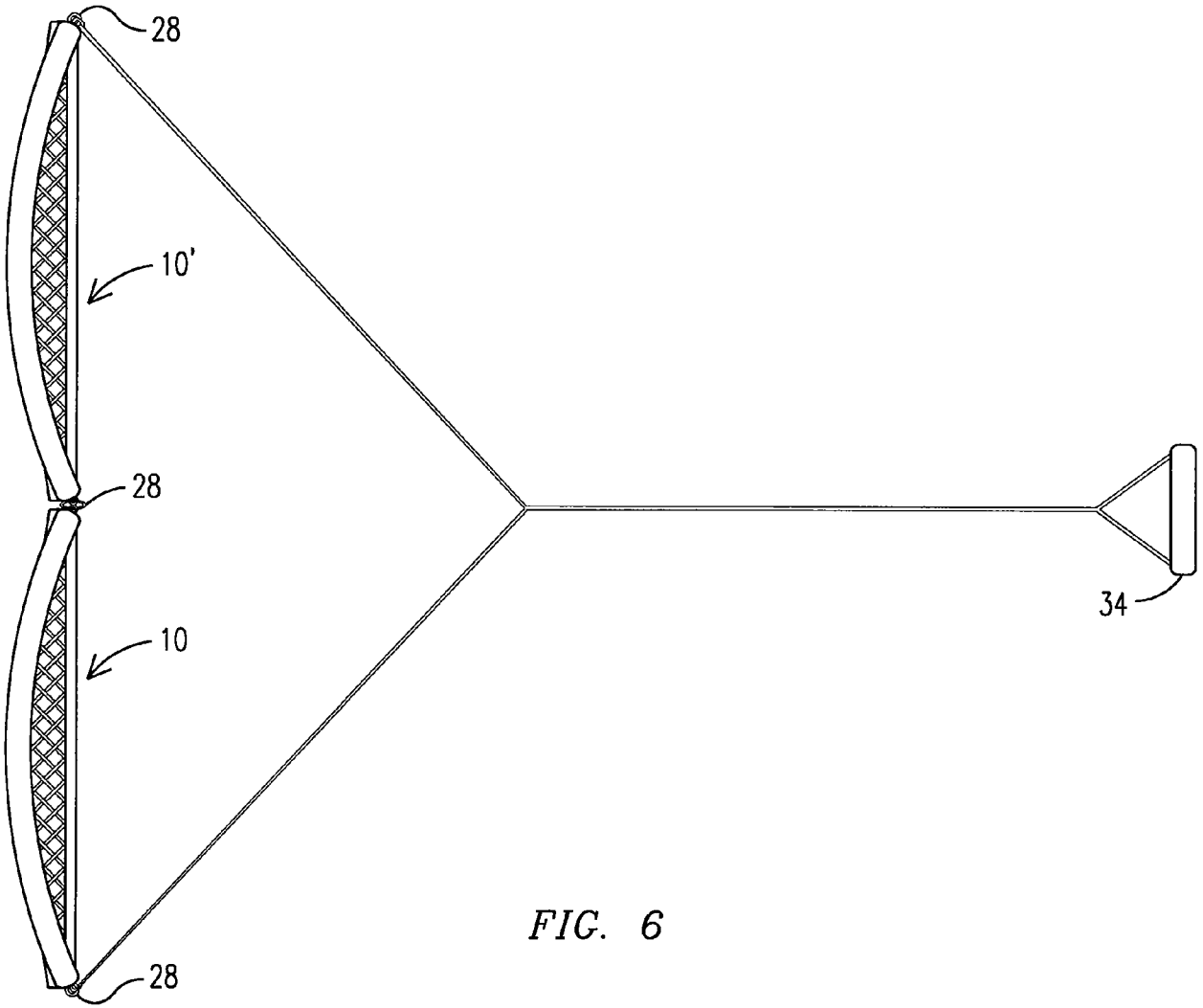
FIG. 6 depicts an exemplary embodiment of a plurality of skimmers connected together.

FIG. 6 depicts an exemplary embodiment of a plurality of skimmers connected together. The connection elements 28 disclosed above for attaching the ropes may also be used to attach a second skimmer 10' to a first skimmer 10. When doing so, the ropes at the location where the two skimmers are connected may not be attached. In this embodiment, the final skimmer apparatus 10 may be as big and/or as small as required by the user. For example, for use at a residence having both a swimming pool and hot tub, the skimmer apparatus 10 may be only a few feet in length, or of a length to fit the width and/or length of the hot tub. When used in the swimming pool, additional skimmers 10', of similar length or of various lengths, may be attached to provide for a larger net material area 14 when used in this bigger body of water. Additional skimmers can likewise be used when the body of water is larger and two users are operating the skimmer apparatus.

Figure 7:
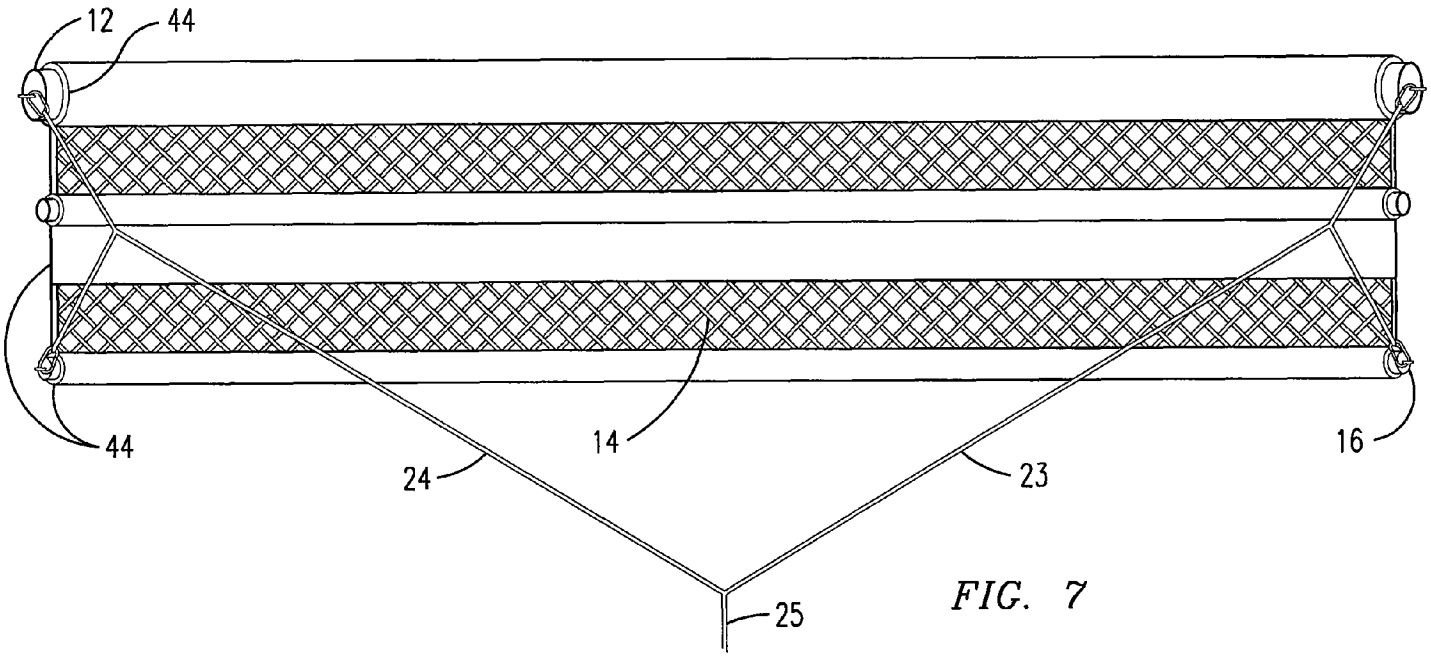
FIG. 7 depicts an exemplary embodiment of two vertically attached skimmers.

In another exemplary embodiment, instead of placing two skimmer apparatus side by side, skimmers can be attached vertically, as illustrated in FIG. 7. In this configuration, the floatation element is maintained within a sleeve cover 44. The floatation element that is below a top skimmer and floatation element is removed from the sleeve cover. The ropes 23, 24 are then attached at the ends of the top-most floatation element and at the bottom-most non-floatation element. In this configuration, this vertical enhanced skimmer apparatus can reach further into the body of water.

While exemplary embodiment of the invention has been described with reference to an exemplary embodiment, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A skimmer apparatus comprising:

a floatation element defining an operative top end and configured to be buoyant;

a non-floatation element defining an operative bottom and configured to submerge when placed in the body of water;

a net material having a top edge connected to the floatation element and a bottom edge connected to the non-floatation element, and extending nearly a complete length of the floatation element; and a guide element comprising a rope material extending from at least one of a first side and second side of the floatation element and first side and the second side of the non-floatation element;

wherein the guide element is configured so that a single individual may operate the skimmer apparatus anywhere within a body of water without assistance from a second individual where a reach of the skimmer apparatus is only limited by a length of the rope material; and wherein the net material is further configured without a rigid side member extending from the floatation device to the non-floatation device so that the net material is configured to close off side edges of the net material, that extends between the floatation element and non-floatation element, when the skimmer apparatus is removed from the body of water; and wherein the guide element comprises a plurality of ropes, a first rope individually extending from the first side of the floatation element, a second rope individually extending from the second side of the floatation element, a third rope individually extending from the first side of the non-floatation element, a fourth rope individually extending from the second side of the non-floatation element, and fifth rope that is connected to each respective end of the first, second, third, and fourth rope at a location away from the floatation element and non-floatation element so that a location within the body of water that the single individual uses the skimmer apparatus is only limited by the length of the ropes.

2. The skimmer apparatus according to claim 1, further comprising a handle attached to the end of the guide element distant from the floatation element and the non-floatation element.

3. The skimmer apparatus according to claim 1, wherein at least one of the floatation element and non-floatation element is foldable in half for storage.

4. The skimmer apparatus according to claim 1, wherein the net material may be wrapped around at least one of the floatation element and the non-floatation element for storage without removing any elements from the skimmer apparatus.

5. The skimmer apparatus according to claim 1, wherein the plurality of ropes converge to form a single rope element at a distance from the floatation element and the non-floatation element.

6. The skimmer apparatus according to claim 5, wherein a location of the distance is adjustable.

7. The skimmer apparatus according to claim 1, wherein the guide elements extending from the first side of the floatation element and the first side of the non-floatation element converge to form a first rope element and the guide elements extending for the second side of the floatation element and the second side of the non-floatation element converge to form a second rope element.

8. The skimmer apparatus according to claim 7, wherein a first user controls the first rope element and a second user controls the second rope element.

9. The skimmer apparatus according to claim 1, further comprising a connection element configured to connect the guide element to at least one of the floatation element and the non-floatation element.

10. The skimmer apparatus according to claim 9, wherein the connection element is further configured to connect a second skimmer to create a larger skimmer apparatus.

11. The skimmer apparatus according to claim 1, wherein the floatation element includes a sleeve cover in which an inner floatation element is placed.

12. The skimmer apparatus according to claim 11, wherein a lower inner floatation element is removed from the sleeve cover when a first skimmer apparatus is connected across a top of a second skimmer apparatus to create a new skimmer apparatus with an increased vertical distance between an upper floatation element and a lower floatation element.

13. The skimmer apparatus according to claim 1, further comprising a non-rigid re-enforcement element configured to extend along an edge of the net material therebetween the floatation element and the non-floatation element.

14. The skimmer apparatus according to claim 13, wherein the re-enforcement element comprises an elastic characteristic.

15. A skimmer apparatus comprising:

a floatation element defining an operative top end and configured to be buoyant;

a non-floatation element defining an operative bottom and configured to submerge when placed in the body of water;

a net material having a top edge connected to the floatation element and a bottom edge connected to the non-floatation element, and extending nearly a complete length of the floatation element;

a guide element comprising a rope material extending from at least one of a first side and second side of the floatation element and first side and the second side of the non-floatation element; and a re-enforcement element extending along an edge of the net material from the floatation element to the non-floatation element;

wherein the guide element is configured so that a single individual may operate the skimmer apparatus anywhere within a body of water without assistance from a second individual where a reach of the skimmer apparatus is only limited by a length of the rope material; and wherein the net material is further configured without a rigid side member extending from the floatation device to the non-floatation device so that the net material is configured to close off side edges of the net material, that extends between the floatation element and non-floatation element, when the skimmer apparatus is removed from the body of water.

16. The skimmer apparatus according to claim 15, wherein the re-enforcement element is elastic.

17. A skimmer apparatus comprising:

a floatation element defining an operative top end and configured to be buoyant;

a non-floatation element defining an operative bottom and configured to submerge when placed in the body of water;

a net material having a top edge connected to the floatation element and a bottom edge connected to the non-floatation element, and extending nearly a complete length of the floatation element; and a guide element comprising a rope material extending from at least one of a first side and second side of the floatation element and first side and the second side of the non-floatation element;

wherein the guide element is configured so that a single individual may operate the skimmer apparatus anywhere within a body of water without assistance from a second individual where a reach of the skimmer apparatus is only limited by a length of the rope material;

wherein the net material is further configured without a rigid side member extending from the floatation device to the non-floatation device so that the net material is configured to close off side edges of the net material, that extends between the floatation element and non-floatation element, when the skimmer apparatus is removed from the body of water; and wherein the floatation element is configured to take an arcuate shape when being pulled through a body of water while the non-floatation element retains a non-bendable shape.

* * * * *